United States Patent [19]

Martin

[11] Patent Number: 4,843,993

[45] Date of Patent: Jul. 4, 1989

[54] SHIP HAVING A STERN SCREW AND A METHOD OF OPERATING THE SHIP

[75] Inventor: Patrick G. Martin, Cork, Ireland

[73] Assignee: Sulzer Brothers Limited, Winterthur, Switzerland

[21] Appl. No.: 94,252

[22] Filed: Sep. 4, 1987

[30] Foreign Application Priority Data

Sep. 12, 1986 [CH] Switzerland ..... 3668/86

[51] Int. Cl.[4] ..... B63B 13/00

[52] U.S. Cl. ..... 114/125

[58] Field of Search ..... 114/57, 121, 125, 330, 114/333; 244/135 C

[56] References Cited

U.S. PATENT DOCUMENTS 3,014,449 12/1961 Nitzki et al. ..... 114/57

FOREIGN PATENT DOCUMENTS 0545311 3/1932 Fed. Rep. of Germany .
3303554 2/1983 Fed. Rep. of Germany .
341591 8/1904 France ..... 114/125
0805802 9/1936 France .
0948907 2/1949 France .
13036 of 1903 United Kingdom ..... 114/121
0904702 8/1962 United Kingdom .

*Primary Examiner*—Sherman D. Basinger
*Attorney, Agent, or Firm*—Kenyon & Kenyon

[57] ABSTRACT

The hull has a draught at the rear end, corresponding to the normal position of the ship for deep-water operation, greater than the draught of the front end, the keel line thereof descending correspondingly front to rear. The central or middle draught corresponds to the design draught allowable for operation in shallow water. The hull has a system for trimming the fully laden ship employing stern and bow fuel tanks. For shallow water operation, the hull is lowered at the bow and raised correspondingly at the stern, by displacement of fuel from the stern tank to the bow tank, into a trim position in which the keel line extends parallel to the water line. This construction enables the screw to be optimized substantially independently of draught-imposed limitations and the screw can have a diameter greater by the amount of stern lift than fixedly mounted screws of conventional designs.

11 Claims, 1 Drawing Sheet

SHIP HAVING A STERN SCREW AND A METHOD OF OPERATING THE SHIP

This invention relates to a ship having a stern screw and to a method of operating the ship. More particularly, this invention relates to a method of adjusting the depth of immersion of the screw of a ship.

Heretofore, ships have been known, particularly those having a slow-running engine and a large-diameter screw, in which maximum screw diameter and immersion depth are limited mainly by the draught of the ship which is the determining factor in screw design. Further, the design draught is usually that which occurs for travelling in shallow water, for example, at harbor entries and near the coast. As such, this design draught is relevant only for a small proportion of the time that a ship is in operation. Correspondingly, the screw cannot be optimized to the conditions which are operative for, by far, the major proportion of operating time and which would, due to the absence of depth restriction, readily permit the use of a much larger diameter screw optimized for propulsion efficiency and fuel economy.

It has also been known, for example, as described in German O.S. No. 3303554, that a large diameter screw can be disposed on a pivoted screw shaft which, in turn, is adjustable between a bottom operative position for use in deep water and an inactive top position for use in shallow water. When in the bottom position, the screw hub is below the keel line and when in the top inactive position, the screw hub is above the keel line and the vanes of the screw are locked in this position. However, such a known screw arrangement requires a relatively elaborate mounting and control of the screw shaft. In addition, the screw arrangement requires an auxiliary drive to drive and steer the ship in shallow water.

Accordingly, it is an object of the invention to optimize the screw diameter and immersion depth of a stern screw of a ship.

It is another object of the invention to improve the screw efficiency of a ship with a reduced outlay and, particularly, without additional mechanical control means and without interruption of power transmission.

It is another object of the invention to be able to trim a hull of a ship in a relatively simple manner while optimizing screw efficiency.

It is another object of the invention to optimize screw diameter and immersion depth substantially free of draught-imposed limitations.

Briefly, the invention provides a ship having a hull with a keel line bounding a bottom thereof and a stern screw at a rear of the hull with means for trimming the hull between a normal position for a fully-laden hull travelling in deep water and a trim position for travelling in shallow water. When in the normal position, the hull has a greater draught at the rear end of the hull than at the front end of the hull relative to a water line of the hull. When in the trim position, the front end of the hull is lowered from the normal position while the rear end is lifted from the normal position relative to the water line.

The means for trimming the hull is in the form of a trimming system having at least one stern fuel tank and at least one bow fuel tank connectable to the stern fuel tank for transferring fuel therebetween. In addition, the trimming system may employ at least one stern ballast tank and at least one bow ballast tank connectable to the stern ballast tank for transferring ballast therebetween.

The invention also provides a method of operating a ship having a stern screw wherein the ship is trimmed from a normal position for deep water travel to a trim position for shallow water travel by lowering the bow a predetermined amount relative to a water line and by lifting the stern a corresponding amount relative to the water line. In addition, the trim position is maintained for shallow water travel and trimming of the ship from the trim position to the normal position is performed for deep water travel.

In operating the ship, the screw can be very simply adjusted to any required immersion depth. Further, the screw may have a diameter greater than conventional stern screws by the amount of stern lift.

The hull has an improved underwater shape since the keel part, which is lengthened downwardly as compared with conventional ships, ensures an improved approach flow for the relatively low screw.

Where the trimming system includes the interconnected stern and bow fuel tanks and interconnected stern and bow ballast tanks, the ballast tanks can be made with a capacity corresponding at least substantially to the capacity of the fuel tanks. This enables a loaded ship to be trimmed, or the corresponding trim position to be retained, for example, during loading, by the displacement of fuel either alone or in association with floodable ballast tanks.

In order to enable the ship to be maintained in the trim position, with the keel line parallel to the water line, the difference between the draught measured at the stern end of the hull and the draft measured near the center of buoyancy of the hull is made to correspond to the operationally greatest predetermined lift of the stern end of the hull.

The hull may also be made of a plurality of frame cross-sectional surfaces which are distributed over the length of the hull and constructed relative to the center of buoyancy of the hull for the normal position. Further, the hull may be provided with a shape at the rear end upstream of and aligned with the screw to provide for a uniform approach flow over the periphery of the screw. This permits lower screw load variations and improved efficiency.

Of note, German Patent 545,311 describes a hull having a horizontal keel line with an after part in the rear end defined by substantially pear-shaped frame lines. However, this known construction of the after part does not provide for an improvement in screw approach flow comparable with the effect provided by the downwardly lengthened keel part and the correspondingly lower position of the screw as described above.

These and other objects and advantages of the invention will become more apparent from the following detailed description taken in conjunction with the accompanying drawings wherein.

Figure 1:
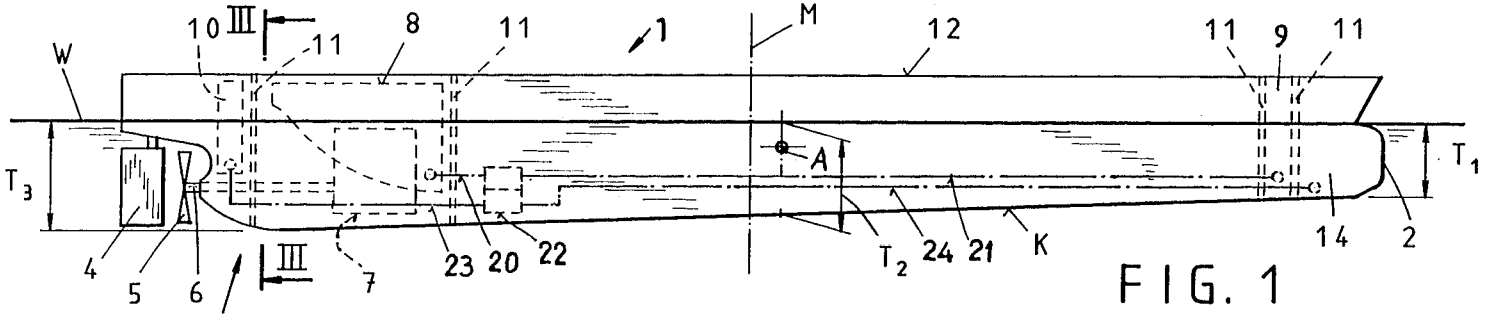
FIG. 1 illustrates a side view of a ship constructed in accordance with the invention in a normal position.

Referring to FIG. 1, the ship has a hull 1 with a bow or front end 2 and a stern or rear end 3. In addition, a stern rudder 4 and a screw 5 are disposed at the stern 3 with the screw 3 drivingly coupled by a shaft 6 with a driving engine 7 inside the hull 1.

The hull 1 is subdivided by bulkheads 11 and is provided with two stern fuel tanks 8 (only one of which is shown) and a bow fuel tank 9 which is connectable to the stern tanks 8 in a known manner.

The ship has a center of buoyancy A located forwardly of a center plane M and has a water line W when fully-laden above the center of buoyancy A.

The operative position of the ship shown in FIG. 1 corresponds to a normal position for deep-water operation. In this position, a deck part 12 of the ship (illustrated for simplicity as a straight line) extends parallel to the water line W. When in a trim position for travelling in shallow water, the deck part 12 inclines forwardly towards the water line W as indicated in FIG. 2.

As indicated in FIG. 1, the hull 1 has a keel line K which bounds a bottom of the hull. When in the normal position, the keel line K is at an inclination to the horizontal and slopes downwardly from the bow 2 to the stern 3. Consequently, the stern has a draught $T_3$ relative to the water line W which is greater than the corresponding draught $T_1$ at the bow end.

Figure 2:
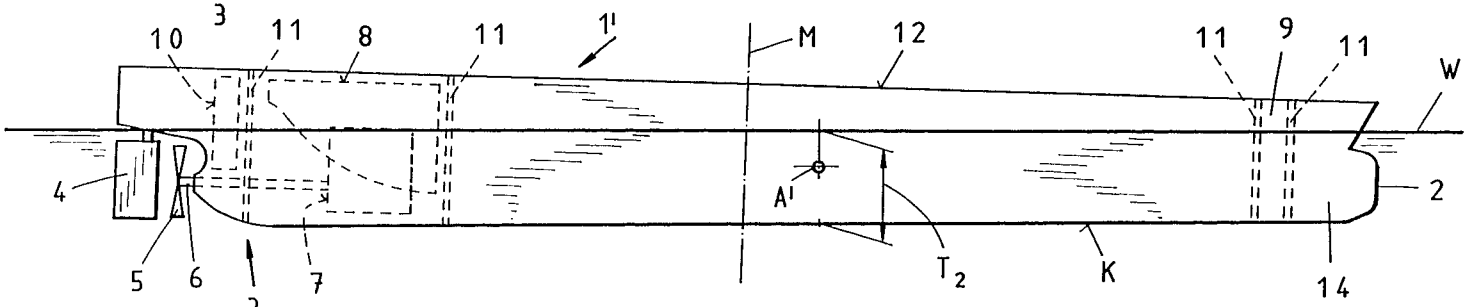
FIG. 2 illustrates the ship of FIG. 1 in a trim position in accordance with the invention.

The ship is also provided with means in the form of a trimming system for trimming the hull 1 between the normal position of FIG. 1 for a fully-laden hull travelling in deep water and a trim position as shown in FIG. 2. When in the normal position, there is a greater draught at the rear end of the hull 1 than at the front end relative to the water line W. While in the trim position, the front end of the hull 1' is lowered from the normal position and the rear end is lifted from the normal position as indicated in FIG. 2. To this end, the trimming system functions to convey fuel from the stern fuel tanks 8 to the bow fuel tank 9 via known lines 20,21 and controls 22, as indicated in FIG. 1, so that the bow part of the hull 1 descends around the center of buoyancy A and the stern part lifts by a corresponding predetermined amount, for example, of 1 to 2 meters in the case of a ship having a length of approximately 180 meters to the trim position 1' shown in FIG. 2. That is, the rear end of the hull 1 is lifted an amount of approximately 0.5 to 1% of the length of the ship.

The trimming of the ship into the position indicated in FIG. 2 can be performed for operation in shallow water, for example, before entering coastal waters and in harbors.

The angle of inclination of the keel line K to the water line W can be such that the difference between the stern draught $T_3$ and a center draught $T_2$ measured near the center of buoyancy A corresponds to the predetermined amount of stern lift. This permits the trim position of the hull 1 to bring the keel line K into a substantially parallel arrangement with the water line W. The central draught $T_2$ corresponds to the permissible design draught of the ship for operation in shallow water.

Of note, when the ship is trimmed, the center of buoyancy A is displaced from the optimum position shown in FIG. 1 into a position A' which is shown in FIG. 2 and which corresponds to the trim position. This slight displacement, shown to an exaggerated scale in the drawings, is allowable since it can be assumed that the ship navigates at reduced speed in shallow water.

The volume of the stern fuel tanks 8 is such that the tanks can, at any time, receive the quantity of fuel present in the bow fuel tank 9. In addition to the tanks 8, other fuel tanks (not shown) can be provided in known manner preferably in the after-part. If the quantity of fuel available in the stern tanks 8 is inadequate for the ship to be trimmed, for instance, if the fuel supply is substantially exhausted, a corresponding trimming can be effected by flooding a ballast tank 14 in the bow zone. To ensure that the ship remains in the normal position even when the quantity of fuel is low, a correspondingly dimensioned floodable ballast tank 10 can be provided in the stern. The ballast tanks 10 and 14 can be interconnected via lines 23,24 and the controls 22.

Figure 3:
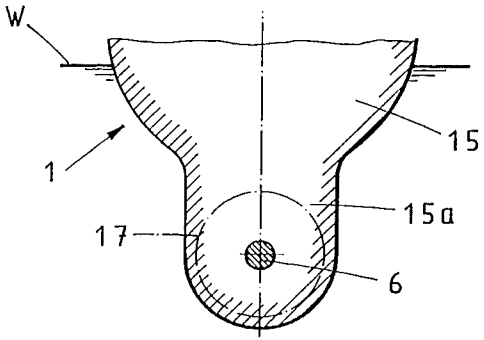
FIG. 3 illustrates a partial sectional view taken on line III—III of FIG. 1.

The hull shape is determined by frame or rib crosssectional surfaces 15 which are assumed to be distributed over the length of the ship and constructed in accordance with the predetermined position of the center of buoyancy A of the hull 1 in the normal position. As indicated in FIG. 3, one of such surfaces 15 which are associated with the stern part has zones **15*a* near the axial end projection of the screw circle 17, shown in chain-dotted line, to provide for a uniform approach flow over the periphery of the screw 5. In this respect, the stern of the hull 1 defined by the surfaces 15a has the shape of a body of displacement disposed upstream of the screw circle 17. Since the screw 5 is positioned relatively low down with the ship in the normal position, these zones 15a** can be optimized to make the screw approach uniform over much of the screw periphery.

The invention thus provides a ship with a trimming system which permits the ship to be readily operated at maximum screw efficiency in both shallow water and deep water. Further, the trimming system is of relatively simple construction so that there need not be any interruption in screw operation when changing from a normal hull position to a trimmed position.

What is claimed is:

1. A ship comprising a hull having a keel line bounding a bottom thereof and having a normal position for fully-laden travelling in deep water with a greater draught at a rear end of said hull than at the front end of said hull relative to a water line of said hull;

a stern screw at a rear of said hull; and a trimming system for trimming said hull between said normal position and a trim position with said front end lowered from said normal position and said rear end lifted from said normal position, said system having at least one afterpart fuel tank, at least one bow fuel tank connectable to said afterpart fuel tank for transferring fuel therebetween to move said hull between said normal position and said trim position, at least one stern ballast tank and at least one bow ballast tank connectable to said stern ballast tank for transferring ballast therebetween.

2. A ship as set forth in claim 1 wherein each ballast tank has a capacity corresponding to the capacity of a fuel tank.

3. A ship as set forth in claim 1 wherein said keel line extends at an angle to said water line and at a distance increasing from front to rear of said hull and wherein the differences between the draught at said rear end and the draught at the center of buoyancy of said hull corresponds to the operationally greatest predetermined lift of said rear end.

4. A ship as set forth in claim 3 wherein said hull includes a plurality of frame cross-sectional surfaces distributed over the length of said hull and constructed relative to the center of buoyancy of said hull in said normal position.

5. A ship as set forth in claim 4 wherein said hull has a shape at said rear end upstream of and aligned with said screw to provide for a uniform approach flow over the periphery of said screw.

6. A ship as set forth in claim 1 wherein said hull has a shape at said rear end upstream of and aligned with said screw to provide for a uniform approach flow over the periphery of said screw.

7. A ship as set forth in claim 1 wherein said rear end of said hull is lifted an amount of approximately 0.5 to 1 per cent (%) of the length of the ship.

8. A ship as set forth in claim 1 wherein said rear end is lifted and said forward end is lowered an equal amount.

9. A ship as set forth in claim 1 further comprising an engine at said rear end of said hull drivingly connected to said screw.

10. A ship comprising a hull having a keel line bounding a bottom thereof and having a fully laden normal position for travelling in deep water with a greater draught at a rear end of said hull than at a front end of said hull relative to a water line of said hull;

a stern screw at said rear end of said hull within said draught of said rear end;

a trimming system including at least one stern fuel tank and a bow fuel tank connected with said stern fuel tank for transferring fuel therebetween to trim a fully-laden hull from said normal position to a trim position with said keel line substantially parallel to said water line;

a floodable ballast tank in said bow; and a floodable ballast tank in an after-part of said hull connected with said bow ballast tank for trimming said hull when said fuel tanks contain a low quantity of fuel.

11. A ship as set forth in claim 10 wherein said rear end of said hull is lifted an amount of approximately 0.5 to 1% of the length of said hull in moving from said normal position to said trim position.

* * * * *